US007435107B2

(12) United States Patent
Masumoto et al.

(10) Patent No.: US 7,435,107 B2
(45) Date of Patent: Oct. 14, 2008

(54) ELECTRICAL CONNECTOR WITH SIGNAL PAIRED CONTACTS AND GROUND CONTACTS ARRANGED TO MINIMIZE OCCURANCE OF CROSSTALK

(75) Inventors: Toshio Masumoto, Tokyo (JP); Kazuhiro Fujino, Tokyo (JP); Yukiko Sato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/708,529

(22) Filed: Feb. 20, 2007

(65) Prior Publication Data

US 2007/0197064 A1 Aug. 23, 2007

(30) Foreign Application Priority Data

Feb. 20, 2006 (JP) ..... 2006-042231

(51) Int. Cl.
*H01R 12/00* (2006.01)

(52) U.S. Cl. ..... 439/79; 439/941

(58) Field of Classification Search ..... 439/79, 439/941, 608, 108

See application file for complete search history.

(56) References Cited

U.S. PATENT DOCUMENTS 6,350,134 B1 * 2/2002 Fogg et al. ..... 439/79
6,540,559 B1 * 4/2003 Kemmick et al. ..... 439/608
2004/0058572 A1 * 3/2004 Fromm et al. ..... 439/101

FOREIGN PATENT DOCUMENTS

| | | |
|---|---|---|
| JP | 5-716 | 8/1994 |
| JP | 3564555 | 11/2002 |
| JP | 2004 534358 T | 11/2004 |
| JP | 2005-503656 | 2/2005 |

OTHER PUBLICATIONS

Japanese Office Action dated Jul. 30, 2008 in Japanese Application no. 2006-042231.

* cited by examiner

*Primary Examiner*—Renee S Luebke
*Assistant Examiner*—Vanessa Girardi
(74) *Attorney, Agent, or Firm*—Collard & Roe, P.C.

(57) ABSTRACT

In a connector adapted to be connected to a mating object in a first direction, a plurality of contacts arranged in a second direction intersecting the first direction. Each of the contacts includes a contacting portion to be contacted with a mating object and an intermediate portion between the contacting portion and a terminal portion. The contacts includes a plurality of paired signal contacts and a plurality of ground contacts. A combination of the paired signal contacts in one of the rows and the ground contact in the other row forms a first set. A combination of the paired signal contacts in the other row and the ground contact in the one row forms a second set. Adjacent ones of the intermediate portions in the first and the second sets are shifted in position from each other in the first direction.

10 Claims, 9 Drawing Sheets

ELECTRICAL CONNECTOR WITH SIGNAL PAIRED CONTACTS AND GROUND CONTACTS ARRANGED TO MINIMIZE OCCURANCE OF CROSSTALK

This application claims priority to prior Japanese patent application JP 2006-42231, the disclosure of which is incorporated herein by reference.

BACKGROUND OF THE INVENTION

This invention relates to a connector comprising a signal contact for use in signal transmission and a ground contact connected to ground.

For example, an electrical connector of the type is disclosed in Japanese Patent (JP-B) No. 3564555 and Japanese Unexamined Patent Application Publication (JP-A) No. 2004-534358. The electrical connector is suitable for connection of lines transmitting high speed signals by a differential transmission method. In the transmission method, two signal lines (+, −) are used and "High" and "Low" of signals are discriminated by a potential difference between the two signal lines. Two signals transmitted through the two signal lines are equal in voltage level to each other and are different in phase from each other by 180°. In the transmission method, a noise produced in the two signal lines are canceled at an input stage of a receiver. Accordingly, a transmission accuracy is improved.

Referring to FIGS. 1A to 1E and 2, description will be made of an existing connector used in the differential transmission method.

The connector 21 comprises a plurality of signal contacts S, a plurality of ground contacts G, an insulating housing 22 holding the signal contacts S and the ground contacts G, and a shell covering the signal contacts S, the ground contacts G, and the housing 22. The shell 23 has a pair of spring portions 23*a* formed on its upper surface to be engaged with a mating connector.

The contacts S and G of the connector 21 has contacting portions C to be connected to respective contacts of the mating connector. The contacting portions C are arranged in two rows, i.e., upper and lower rows, as shown in FIG. 1B. The contacting portions of the contacts S and G are arranged in the order of S, S, G, . . . from the right side in the upper row and are arranged in the order of G, S, S, . . . from the right side in the lower row.

Referring to FIG. 2, the contacts S and G are similarly arranged in two rows, i.e., upper and lower rows in an upper part of the figure. Specifically, the contacts S, S adjacent to each other in the upper row and the contact G in the lower row are located at apexes of an isosceles triangle, respectively. Similarly, the contact G in the upper row and the contacts S, S adjacent to each other in the lower row are located at apexes of an isosceles triangle, respectively.

The contacts S and G have terminal portions T to be soldered and connected to a substrate. As shown in a lower part in FIG. 2, the terminal portions T are arranged in a single row at a predetermined pitch in the order of S, G, S, S, G, S, . . . from the right side.

However, as shown in FIG. 2, adjacent ones of the signal contacts S are close to each other at their intermediate portions Sm exposed out of the housing 22. Therefore, crosstalk easily occurs.

SUMMARY OF THE INVENTION

It is therefore an object of this invention to provide a connector in which crosstalk hardly occurs.

It is another object of this invention to provide a connector which is compact, low in cost, and excellent in high-frequency characteristic.

Other objects of the present invention will become clear as the description proceeds.

According to an aspect of the present invention, there is provided a connector adapted to be mounted to a substrate and to be connected to a mating object in a first direction, wherein the connector comprises a plurality of contacts arranged in a second direction intersecting the first direction and a housing holding the contacts, wherein each of the contacts comprises a contacting portion to be contacted with the mating object, a terminal portion to be connected to the substrate, and an intermediate portion between the contacting portion and the terminal portion, wherein the contacts include a plurality of paired signal contacts and a plurality of ground contacts wherein the contacting portions of the paired signal contacts and the ground contacts are arranged in two rows extending in the second direction and in a staggered fashion, wherein a combination of the paired signal contacts in one of the rows and the ground contact in the other row forms a first set, wherein a combination of the paired signal contacts in the other row and the ground contact in the one row forms a second set adjacent to the first set in the second direction, and wherein adjacent ones of the intermediate portions in the first and the second sets are shifted in position from each other in the first direction.

DESCRIPTION OF THE PREFERRED EMBODIMENT

Referring to FIGS. 3A to 3G and FIG. 4, description will be made of a connector according to a first embodiment of this invention.

The connector depicted at 1 in the figures is adapted to be connected to a mating connector (not shown) in a first direction D1. The connector 1 comprises a plurality of conductive signal contacts S, a plurality of conductive ground contacts G, an insulating housing 2 holding the signal contacts S and the ground contacts G, and a conductive shell 3 covering the signal contacts S, the ground contacts G, and the housing 2. The shell 3 has a pair of spring portions 3*a* formed on its upper surface. The spring portions 3*a* are brought into contact with a conductive shell of the mating connector when the connector 1 is connected to the mating connector. The signal contacts S and the ground contacts G are generally arranged in parallel in a second direction D2 perpendicular to the first direction D1.

The signal contacts S and the ground contacts G have contacting portions Sc and Gc to be contacted with mating contacts of the mating connector, holding portions Sp and Gp extending from the contacting portions Sc and Gc and held by the housing 2, intermediate portions Sm and Gm extending from the holding portions Sp and Gp and exposed out of the housing 2, and terminal portions St and Gt extending from the intermediate portions Sm and Gm and connected to a substrate by soldering, respectively.

The contacts S and G of the connector 1 are arranged so that, in a fitting portion 1*a*, the contacting portions Sc and Gc and the holding portions Sp and Gp are separately arranged in two rows, i.e., in upper and lower rows. In the upper row, the holding portions Sp and Gp are arranged in the order of Sp, Sp, Gp, . . . , in the second direction D2. In the lower row, the holding portions Sp and Gp are arranged in the order of Gp, Sp, Sp, . . . . The holding portions Sp of two adjacent ones of the signal contacts S in the upper row (hereinafter will be referred to as paired signal contacts in the upper row) and the holding portion Gp of one ground contact G in the lower row faced to the paired signal contacts S in a vertical direction are located at apexes of an isosceles triangle, respectively. Likewise, the holding portions Sp of two adjacent ones of the signal contacts S in the lower row (hereinafter will be referred to as paired signal contacts in the lower row) and the holding portion Gp of one ground contact G in the upper row faced to the paired signal contacts S are located at apexes of an isosceles triangle, respectively.

Figure 1A:
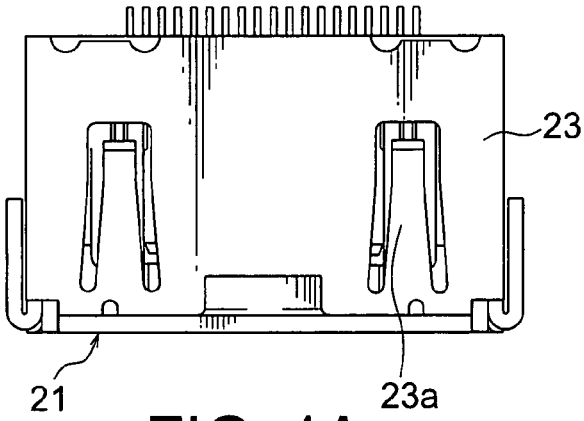
FIG. 1A is a plan view of a conventional connector.
Figure 1E:
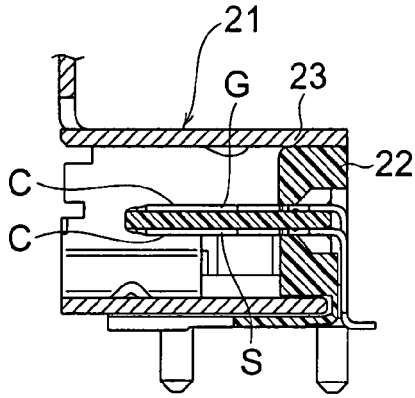
FIG. 1E is a sectional view taken along a line 1*e*-1*e* in FIG. 1B.
Figure 1B:
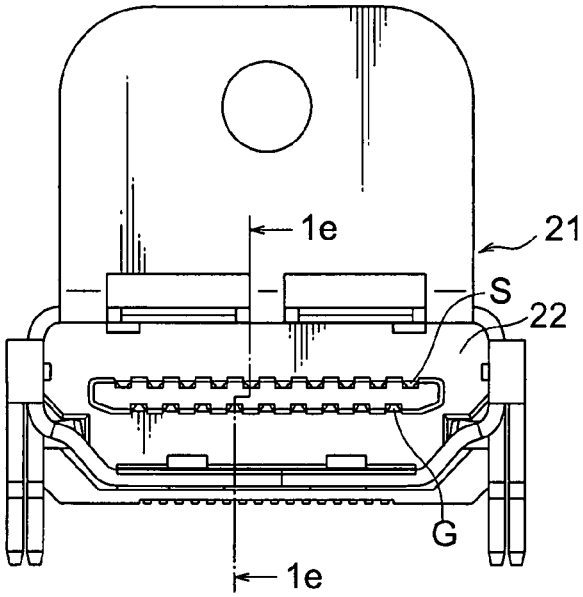
FIG. 1B is a front view of the conventional connector in FIG. 1A.
Figure 1D:
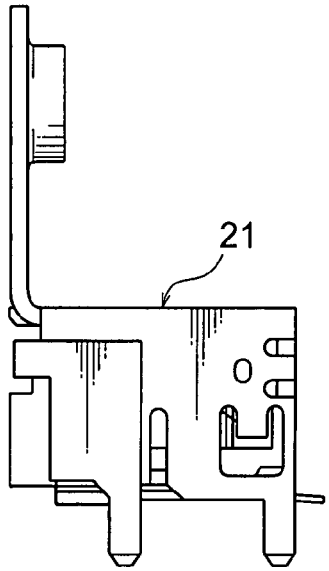
FIG. 1D is a side view of the conventional connector in FIG. 1A.
Figure 1C:
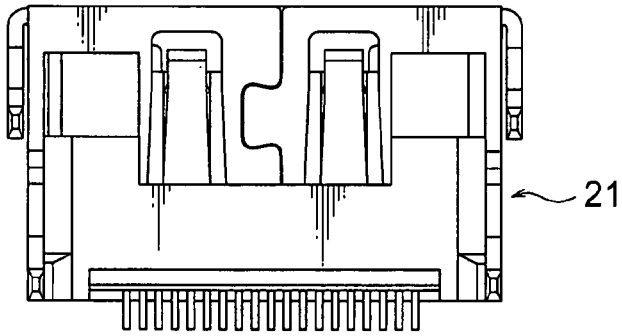
FIG. 1C is a bottom view of the conventional connector in FIG. 1A.
Figure 2:
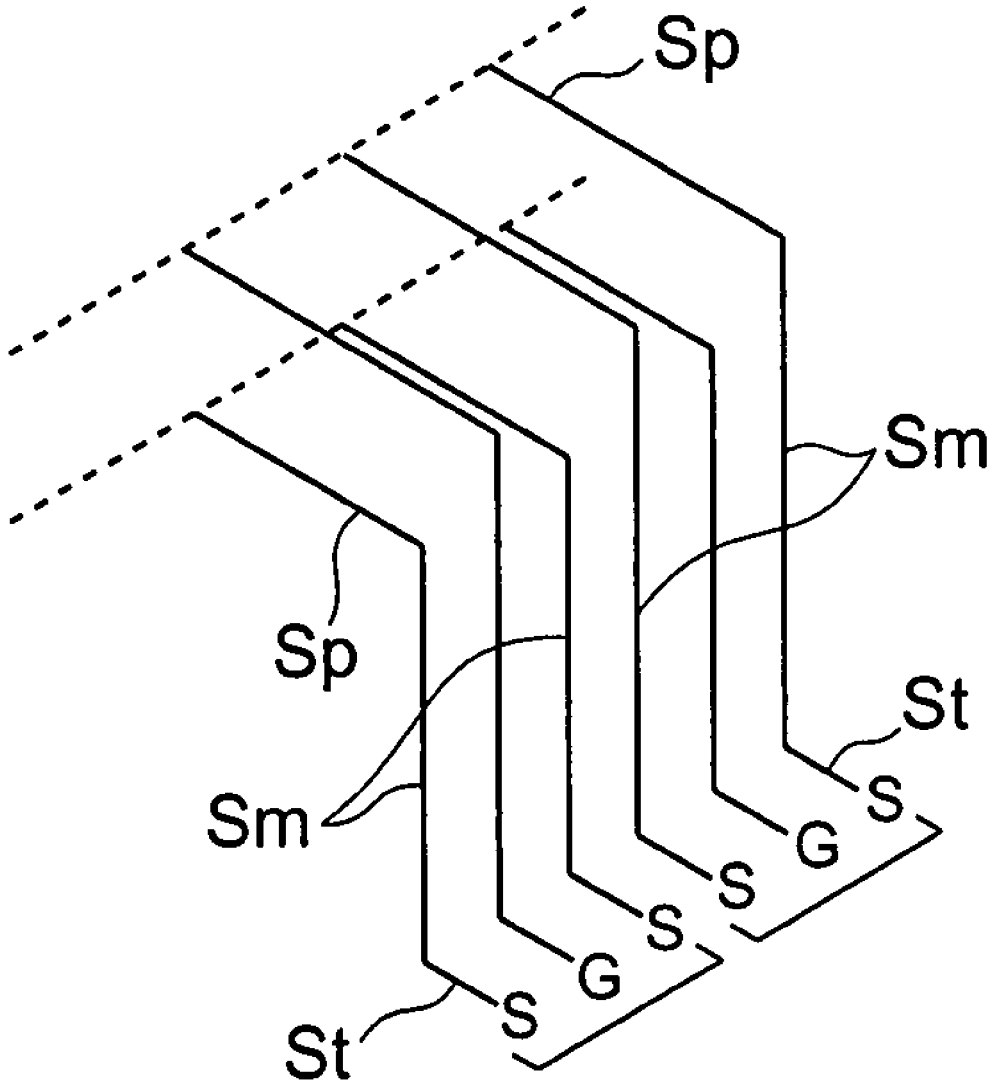
FIG. 2 is a schematic view showing an arrangement of signal contacts and ground contacts of the conventional connector illustrated in FIGS. 1A to 1E.
Figure 3A:
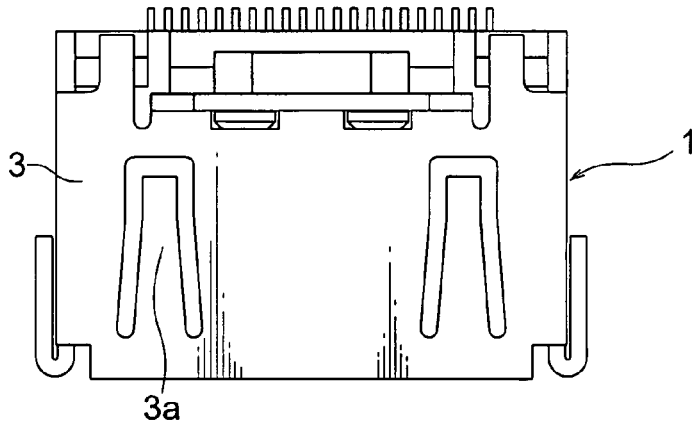
FIG. 3A is a plan view of a connector according to a first embodiment of this invention.
Figure 3B:
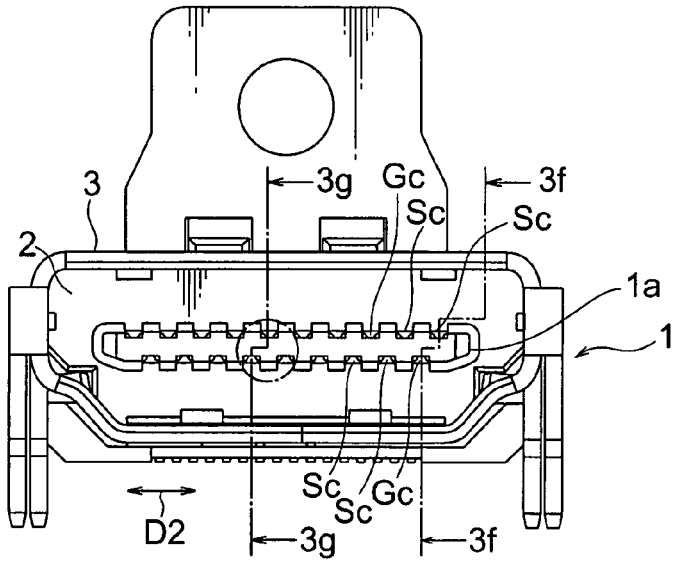
FIG. 3B is a front view of the connector in FIG. 3A.
Figure 3C:
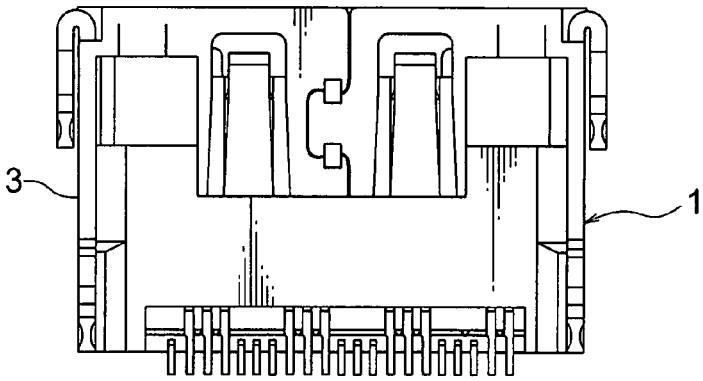
FIG. 3C is a bottom view of the connector in FIG. 3A.
Figure 3D:
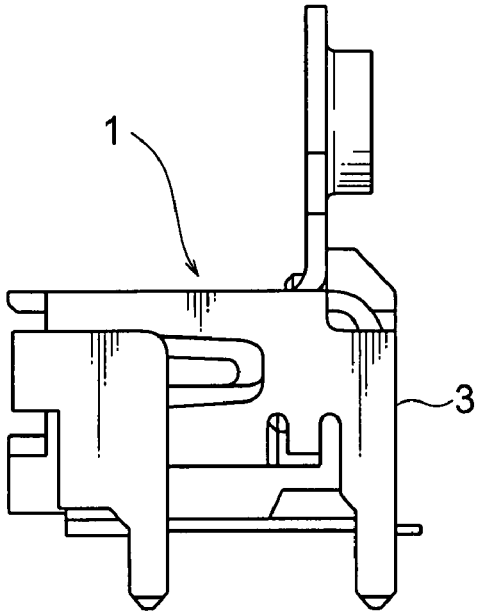
FIG. 3D is a side view of the connector in FIG. 3A.
Figure 3E:
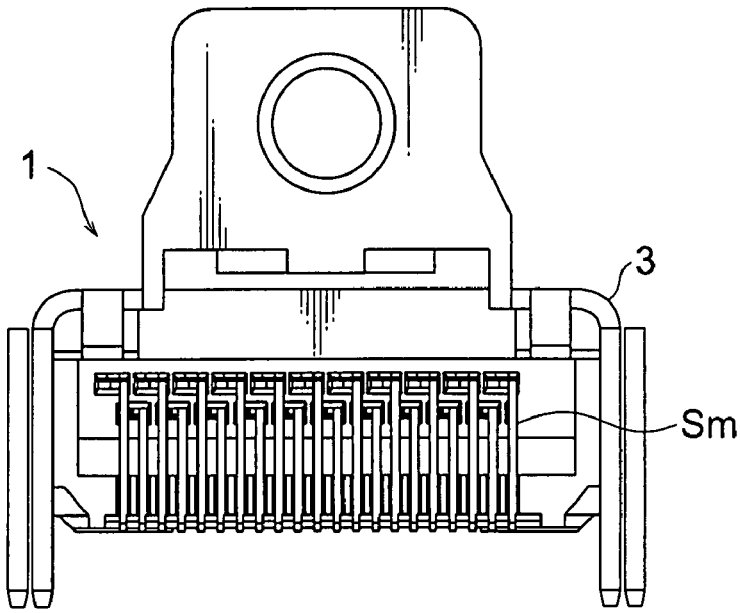
FIG. 3E is a rear view of the connector in FIG. 3A.
Figure 3F:
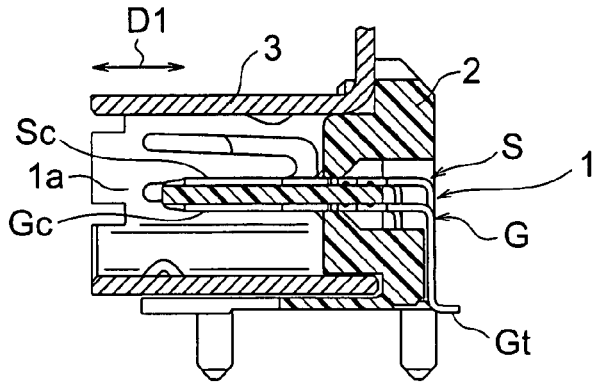
FIG. 3F is a sectional view taken along a line 3*f*-3*f* in FIG. 3B.
Figure 3G:
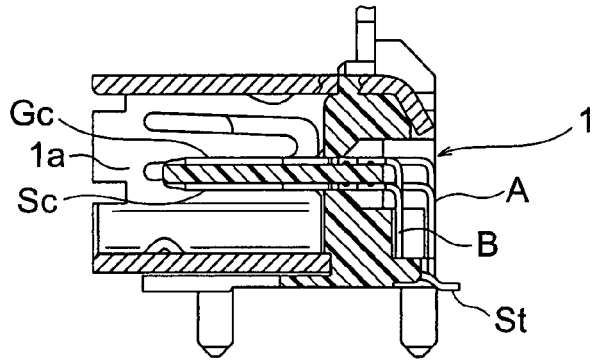
FIG. 3G is a sectional view taken along a line 3*g*-3*g* in FIG. 3B.
Figure 4:
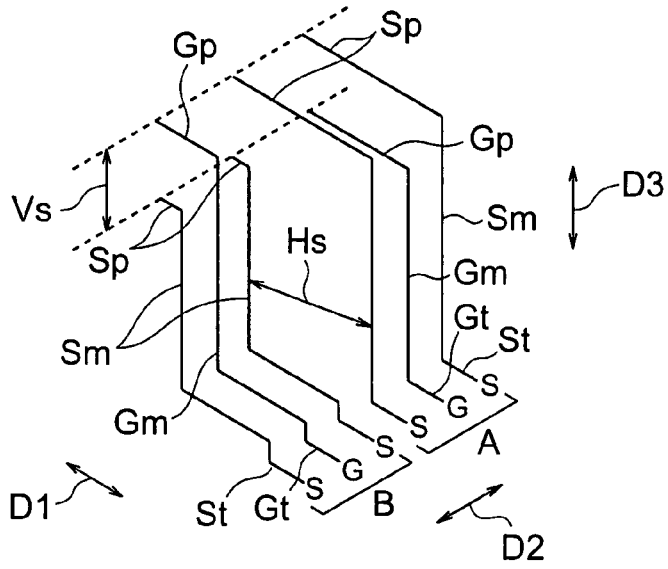
FIG. 4 is a schematic view showing an arrangement of signal contacts and ground contacts of the connector illustrated in FIGS. 3A to 3G.

Referring to FIG. 4 in addition to FIGS. 3A to 3G, the description will be made as regards an arrangement of the signal contacts S and the ground contacts G of the connector illustrated in FIGS. 3A to 3G.

A combination of the paired signal contacts S in the upper row and the ground contact G in the lower row forms a set A. Similarly, a combination of the paired signal contact S in the lower row and the ground contact G in the upper row forms a set B. The sets A and B are arranged adjacent to each other in the second direction D2. Herein, adjacent ones of the intermediate portions Sm in the set A and the set B are shifted in position from each other in the first direction D1. Therefore, at the intermediate portions Sm and Gm, the two adjacent signal contacts S are far distant from each other by a horizontal distance Hs. Accordingly, crosstalk is reduced.

The contacting portions Sc and Gc and the holding portions Sp and Gp are arranged in two rows extending in the second direction D2 and in a staggered fashion as shown in FIG. 3B. In addition, the contacting portions Sc and Gc and the holding portions Sp and Gp are shifted in position from each other by a vertical distance Vs in a third direction D3 perpendicular to the first and the second directions D1 and D2. In addition, a part of the housing 2 is interposed therebetween. Accordingly, crosstalk hardly occurs. The terminal portions St and Gt of the contacts S and G are arranged in a single row at a predetermined pitch in the order of S, G, S, S, G, S, . . . in the second direction D2.

Figure 5:
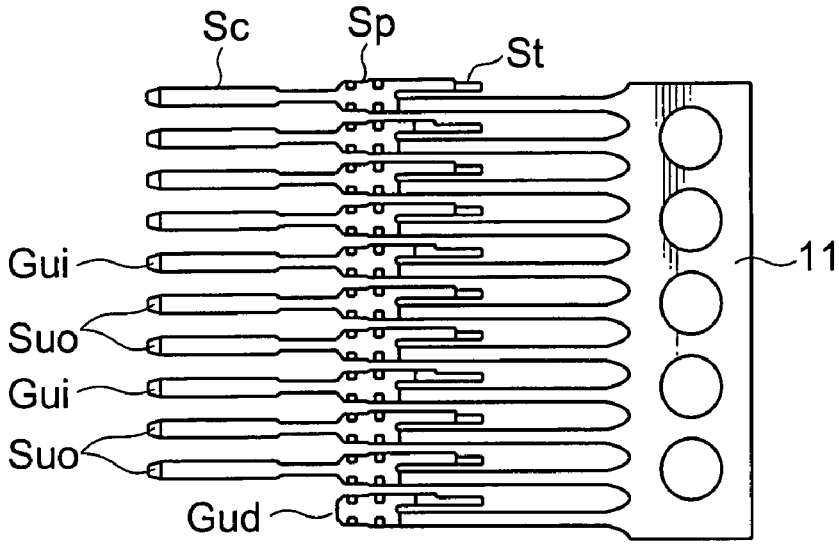
FIG. 5 is a plan view of a first type of contacts in the connector illustrated in FIGS. 3A to 3G in the middle of a production process.
Figure 6:
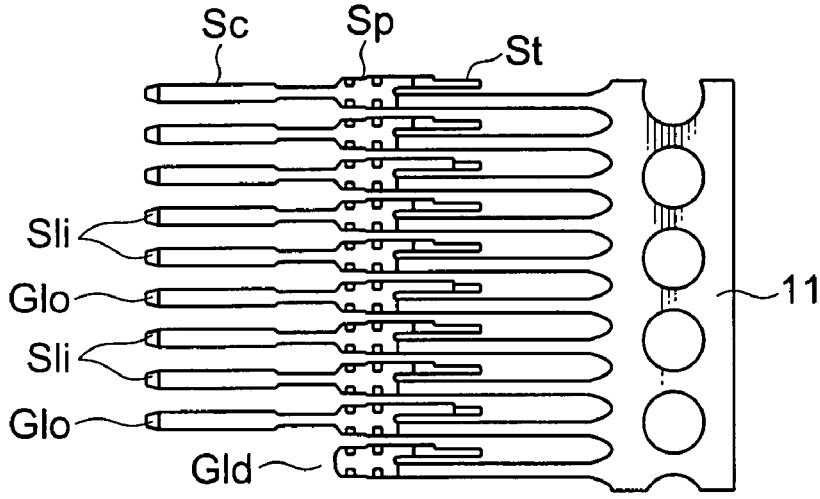
FIG. 6 is a plan view of a second type of contacts in the connector illustrated in FIGS. 3A to 3G in the middle of the production process.

As will be understood from the foregoing description, the contacts are classified into a first type, i.e., upper-row contacts whose holding portions Sp and Gp are arranged in the upper row and a second type, i.e., lower-row contacts whose holding portions Sp and Gp are arranged in the lower row. As shown in FIG. 5, the upper-row contacts are arranged in the order of a dummy ground contact Gud, two outer signal contacts Suo, an inner ground contact Gui, two outer signal contacts Suo, an inner ground contact Gui, . . . from the bottom in the figure. As shown in FIG. 6, the lower-row contacts are arranged in the order of a dummy ground contact Gld, an outer ground contact Glo, two inner signal contacts Sli, an outer ground contact Glo, two inner signal contacts Sli, . . . from the bottom in the figure.

The dummy ground contacts Gud and Gld serve to decrease or compensate a difference in impedance between the pairs of the signal contacts S and to achieve an impedance condition equivalent to another paired signal contacts S.

Herein, description will briefly be made of an assembling process of the connector 1.

At first, the lower-row contacts are temporarily or provisionally inserted into the housing 2. After a carrier 11 is folded and separated from the lower-row contacts, the lower-row contacts are press-fitted into the housing 2.

Next, the upper-row contacts are temporarily or provisionally inserted into the housing 2. After the carrier 11 is folded and separated from the upper-row contacts, the upper-row contacts are press-fitted into the housing 2.

Subsequently, the housing 2 is coupled to the shell 3.

Thus, the assembling process is completed.

Figure 7:
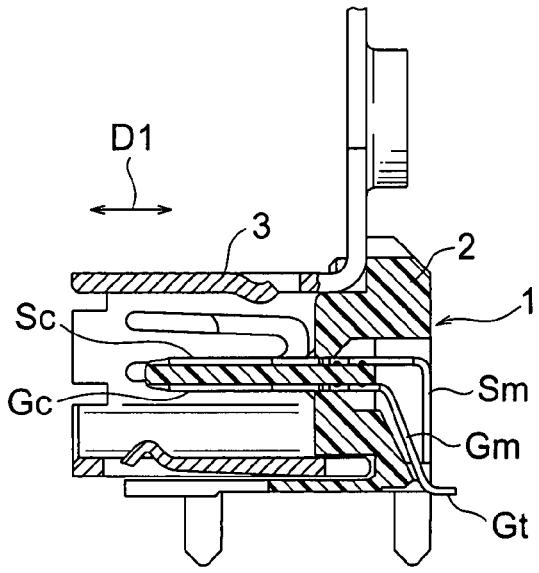
FIG. 7 is a sectional view, similar to FIG. 3G, showing a connector according to a second embodiment of this invention
Figure 8:
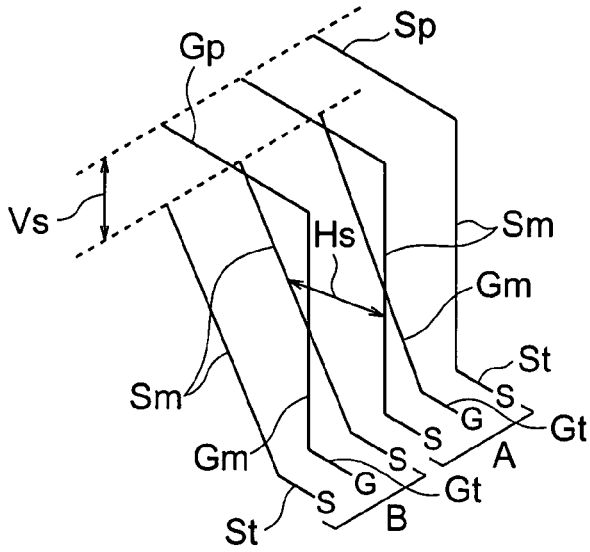
FIG. 8 is a schematic view showing an arrangement of signal contacts and ground contacts of the connector illustrated in FIG. 7.

Referring to FIGS. 7 and 8, description will be made of a connector according to a second embodiment of this invention. Similar parts are designated by like reference numerals and description thereof will be omitted.

Like the connector illustrated in FIGS. 3A to 3G, the connector 1 illustrated in FIG. 7 is adapted to be connected to a mating connector (not shown) in the first direction D1. The paired signal contacts S and the ground contacts G in the upper row are bent so that the intermediate portions Sm and Gm are perpendicular to the holding portions Sp and Gp. The paired signal contacts S and the ground contacts G in the lower row are formed so that the intermediate portions Sm and Gm thereof are inclined with respect to the intermediate portions Sm and Gm and the holding portions Sp and Gp of the paired signal contacts S and the ground contact G in the upper row. With the above-mentioned structure, a horizontal distance Hs between two adjacent signal contacts S is increased so that crosstalk is reduced.

Figure 9:
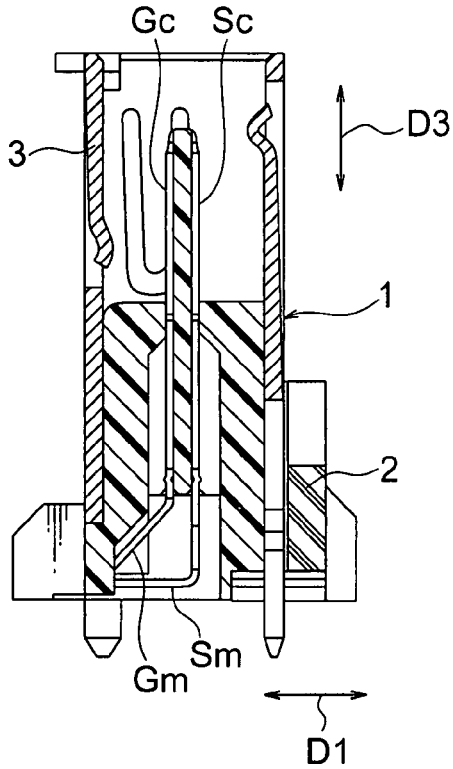
FIG. 9 is a sectional view, similar to FIG. 3G, showing a modification of the connector in FIG. 7.

The connector in FIG. 9 is adapted to be connected to a mating connector (not shown) in the third direction D3.

Figure 10:
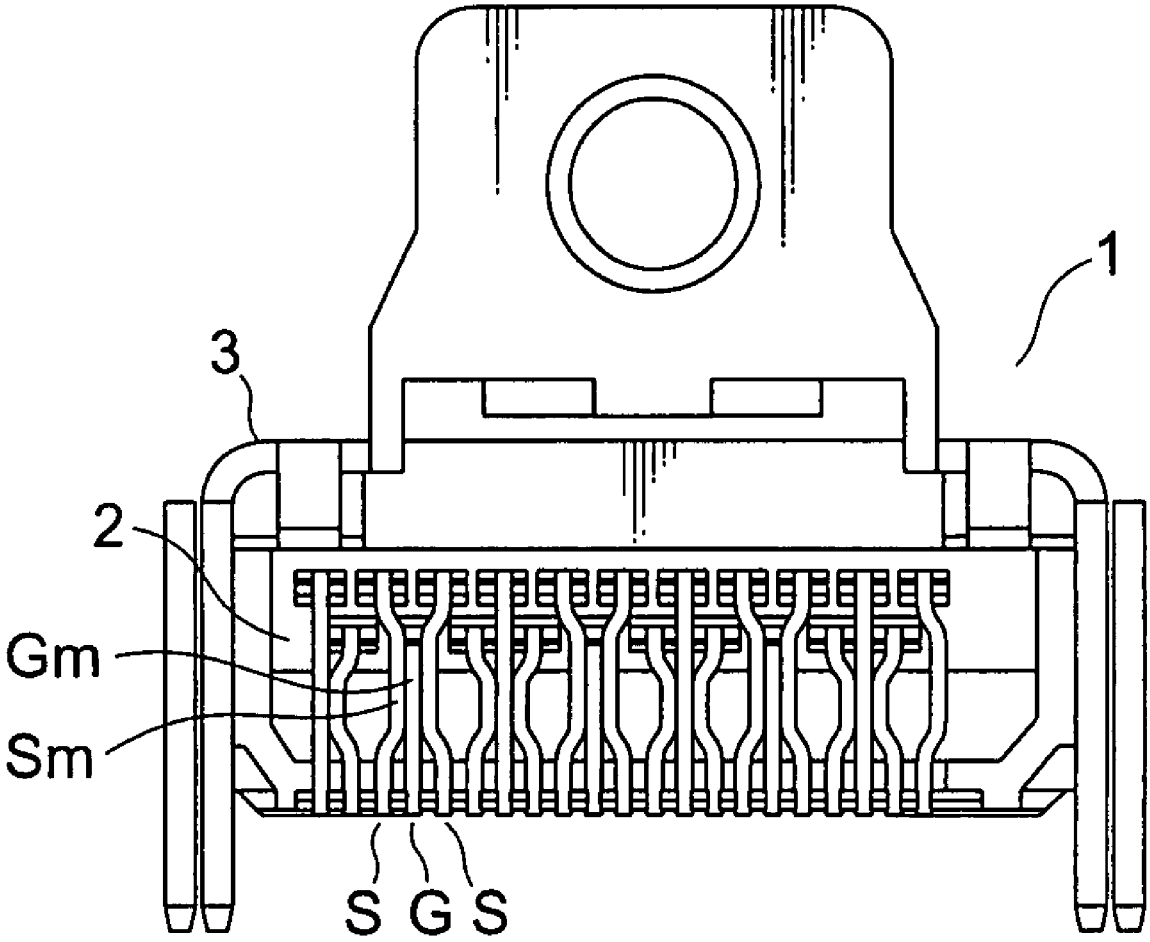
FIG. 10 is a rear view of a connector according to a third embodiment of this invention.

Referring to FIG. 10, description will be made of a connector according to a third embodiment of this invention. Similar parts are designated by like reference numerals and description thereof will be omitted.

The paired signal contacts S and the ground contact G in each of the sets A and B are formed so that the intermediate portions Sm of the paired signal contacts S are bent towards the intermediate portion Gm of the ground contact. With this structure also, crosstalk is reduced.

Figure 11:
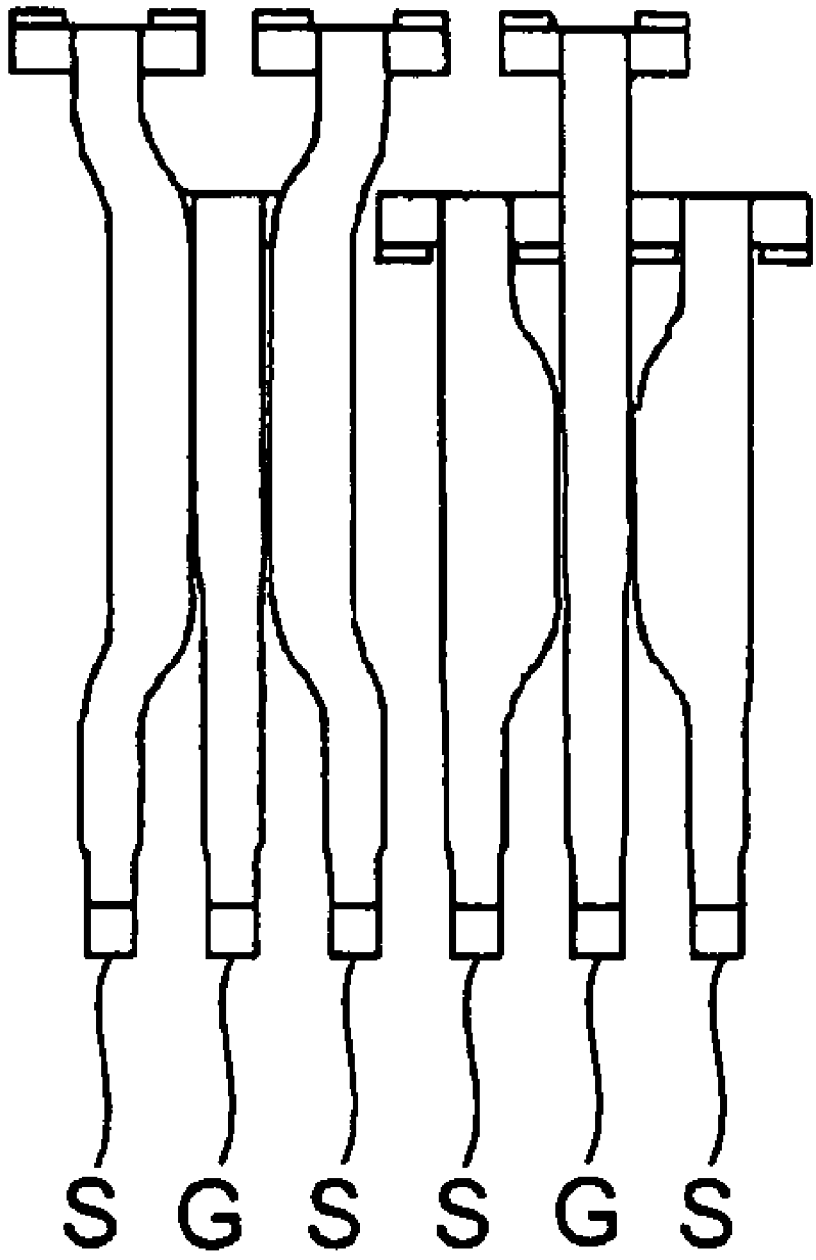
FIG. 11 is a partial view of a modification of the connector illustrated in FIG. 10.

In FIG. 10, the intermediate portions Sm of the signal contacts S are bent to be close to the ground contact G. Alternatively, as shown in FIG. 11, the intermediate portion Sm of each signal contact S may be increased in width as compared with remaining portions.

While the present invention has thus far been described in connection with a few embodiments thereof, it will readily be possible for those skilled in the art to put this invention into practice in various other manners.

What is claimed is:

1. A connector adapted to be mounted on a substrate and to be connected to a mating object in a first direction, wherein the connector comprises:

a plurality of contacts arranged in a second direction intersecting the first direction; and a housing holding the contacts;

wherein each of the contacts comprises:

a contacting portion to be contacted with the mating object;

a terminal portion to be connected to the substrate; and an intermediate portion between the contacting portion and the terminal portion, the intermediate portion protruding from the housing;

wherein the contacts include a plurality of paired signal contacts and a plurality of ground contacts;

wherein the contacting portions of the paired signal contacts and the ground contacts are arranged in two rows extending in the second direction and in a staggered fashion;

wherein a combination of the paired signal contacts in one of the rows and the ground contact in the other row forms a first set;

wherein a combination of the paired signal contacts in the other row and the ground contact in the one row forms a second set adjacent to the first set in the second direction; and wherein, between the first and the second sets, adjacent ones of the intermediate portions are shifted in position from each other in the first direction while adjacent ones of the terminal portions are arranged on a line extending in the second direction.

2. The connector according to claim 1, wherein each of the contacts further comprises a holding portion between the contacting portion and the intermediate portion and held by the housing.

3. The connector according to claim 1, wherein the contacting portions in each of the first and the second sets are located at apexes of an isosceles triangle, respectively.

4. The connector according to claim 1, wherein the intermediate portions of the paired signal contacts are bent towards the intermediate portion of the ground contact in each set.

5. The connector according to claim 1, wherein each of the intermediate portions of the paired signal contacts in each set is increased in width as compared with remaining portions.

6. The connector according to claim 1, wherein the terminal portions of the paired signal contacts and the ground contacts are arranged in a single row in the second direction.

7. The connector according to claim 6, wherein the terminal portion of the ground contact is interposed between the terminal portions of the paired signal contacts.

8. The connector according to claim 1, wherein the intermediate portions in the first set are shifted in position in the first direction from the intermediate portions in the second set.

9. The connector according to claim 8, wherein each contact is bent so that the holding portion is perpendicular to the intermediate portion.

10. The connector according to claim 8, wherein each of the paired signal contacts and the ground contact in the one row is bent so that the holding portion is perpendicular to the intermediate portion while each of the paired signal contacts and the ground contact in the other row is formed so that the intermediate portion is inclined with respect to the holding portion.

* * * * *